US011590498B2

(12) United States Patent
Zhang

(10) Patent No.: US 11,590,498 B2
(45) Date of Patent: Feb. 28, 2023

(54) ARRANGEMENT FOR MIXING FLUIDS IN A CAPILLARY DRIVEN FLUIDIC SYSTEM

(71) Applicant: miDiagnostics NV, Leuven (BE)

(72) Inventor: Lei Zhang, Leuven (BE)

(73) Assignee: miDiagnostics NV, Leuven (BE)

( * ) Notice: Subject to any disclaimer, the term of this patent is extended or adjusted under 35 U.S.C. 154(b) by 343 days.

(21) Appl. No.: 16/641,782

(22) PCT Filed: Aug. 30, 2018

(86) PCT No.: PCT/EP2018/073362

§ 371 (c)(1),
(2) Date: Feb. 25, 2020

(87) PCT Pub. No.: WO2019/043106

PCT Pub. Date: Mar. 7, 2019

(65) Prior Publication Data

US 2020/0353462 A1 Nov. 12, 2020

(30) Foreign Application Priority Data

Aug. 31, 2017 (EP) ..... 17188745

(51) Int. Cl.

| | |
|---|---|
| ***B01L 3/00*** | (2006.01) |
| ***B01F 23/45*** | (2022.01) |
| ***B01F 33/301*** | (2022.01) |
| ***B01F 33/3039*** | (2022.01) |
| ***B01F 35/00*** | (2022.01) |

(Continued)

(52) U.S. Cl.

CPC ..... *B01L 3/50273* (2013.01); *B01F 23/45* (2022.01); *B01F 33/3017* (2022.01); *B01F 33/3039* (2022.01); *B01F 35/189* (2022.01); *B01F 35/7172* (2022.01); *B01F 35/71805* (2022.01); *B01F 2101/23* (2022.01); *B01L 2200/0605* (2013.01); *B01L 2200/0684* (2013.01); *B01L 2300/0867* (2013.01); *B01L 2400/0406* (2013.01)

(58) Field of Classification Search

CPC ..... B01L 3/50273; B01L 2300/0867; B01L 2400/0406; B01F 33/3039; B01F 35/7172; B01F 33/3017; B01F 35/71805; B01F 23/45

See application file for complete search history.

(56) References Cited

U.S. PATENT DOCUMENTS

| | | | |
|---|---|---|---|
| 2002/0166592 | A1 | 11/2002 | Liu et al. |
| 2010/0028986 | A1 | 2/2010 | Hanafusa |

FOREIGN PATENT DOCUMENTS

| | | | |
|---|---|---|---|
| WO | 01/74490 | A2 | 10/2001 |
| WO | 2014/111928 | A1 | 7/2014 |

*Primary Examiner* — Brian J. Sines
(74) *Attorney, Agent, or Firm* — Hodgson Russ LLP

(57) ABSTRACT

There is provided an arrangement (100) which allows for mixing a first fluid with a second fluid at a predetermined volume mixing ratio in a capillary driven fluidic system. The arrangement (100) allows filling an initially empty mixing chamber (110) with the first fluid. The arrangement then allows emptying a predetermined fraction of the first fluid from the mixing chamber (110) such as to form an empty space in the mixing chamber (110). The arrangement then allows filling the empty space of the mixing chamber (110) with the second fluid, thereby allowing a predetermined volume of the first fluid to mix with a predetermined volume of the second fluid over time.

13 Claims, 6 Drawing Sheets

Figure 1A:
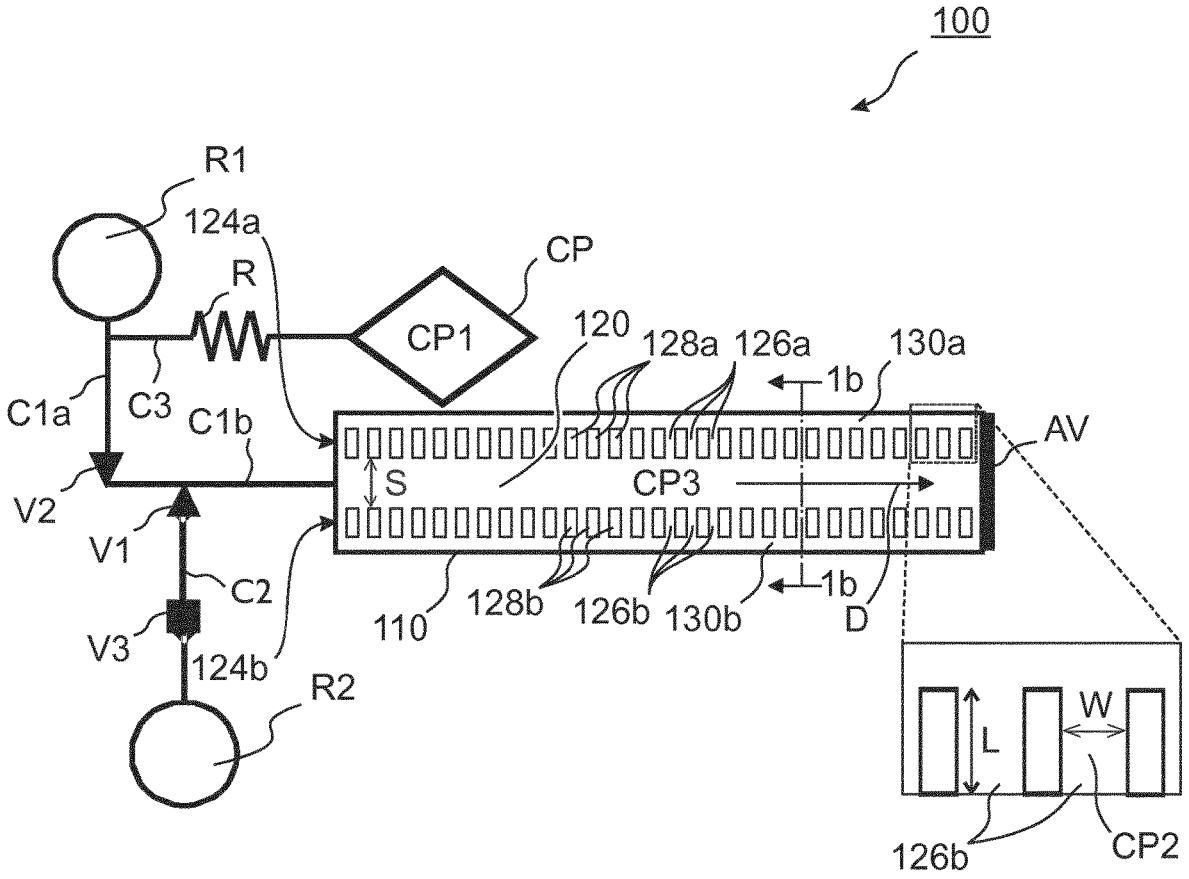

(51) Int. Cl.
*B01F 35/71* (2022.01)
*B01F 101/23* (2022.01)

ARRANGEMENT FOR MIXING FLUIDS IN A CAPILLARY DRIVEN FLUIDIC SYSTEM

TECHNICAL FIELD

This disclosure relates to an arrangement for mixing fluids in a capillary driven fluidic system. Specifically, the disclosure relates to an arrangement for mixing a first fluid with a second fluid at a predetermined volume mixing ratio. The disclosure further relates to a diagnostic device comprising the arrangement.

BACKGROUND

Microfluidics deals with the behavior, precise control and manipulation of fluids that are geometrically constrained to a small, typically sub-millimeter, scale. Technology based on microfluidics are used for example in ink-jet printer heads, DNA chips and within lab-on-a-chip technology. In microfluidic applications, fluids are typically moved, mixed, separated or otherwise processed. In many applications, passive fluid control is used. This may be realized by utilizing the capillary forces that arise within the sub-millimeter tubes. By careful engineering of a so called capillary driven fluidic system, it may be possible to perform control and manipulation of fluids.

Capillary driven fluidic systems may be useful for integrating assay operations such as detection, as well as sample pre-treatment and sample preparation on one chip. For such applications it is often of interest to accurately mix two or more fluids, such as mixing a sample fluid with a buffer fluid so as to dilute the sample fluid. A simple approach for mixing two fluids is to use a simple T-junction and allow the two fluids to meet, and subsequently mix, at the junction. However, in capillary driven fluidic systems, when two fluids mix in such a T-junction, the mixing ratio will depend on the viscosities of the fluids. Because viscosities of bio-fluidic samples, such as blood and plasma, vary among different individuals, accurately mixing of said fluids by capillary driven fluidic systems may be challenging. Hence, there is a need for an improved arrangement in a capillary driven fluidic system which allows for accurately mixing a first fluid with a second fluid at a predetermined volume mixing ratio.

SUMMARY

Exemplary embodiments provide an arrangement which allows for mixing a first fluid with a second fluid at a predetermined volume mixing ratio in a capillary driven fluidic system. The arrangement allows filling an initially empty mixing chamber with the first fluid. The arrangement then allows emptying a predetermined fraction of the first fluid from the mixing chamber such as to form an empty space in the mixing chamber. The arrangement then allows filling the empty space of the mixing chamber with the second fluid, thereby allowing a predetermined volume of the first fluid to mix with a predetermined volume of the second fluid over time. The arrangement may be implemented using purely passive capillary driven fluidic components and thus without active components.

BRIEF DESCRIPTIONS OF THE DRAWINGS

The above, as well as additional objects, features and advantages, will be better understood through the following illustrative and non-limiting detailed description of embodiments described herein, with reference to the appended drawings, where the same reference numerals will be used for similar elements, wherein:

FIG. 1*a* shows a schematic circuit diagram of an arrangement in a capillary driven fluidic system according to embodiments of the present disclosure.

Figure 1B:
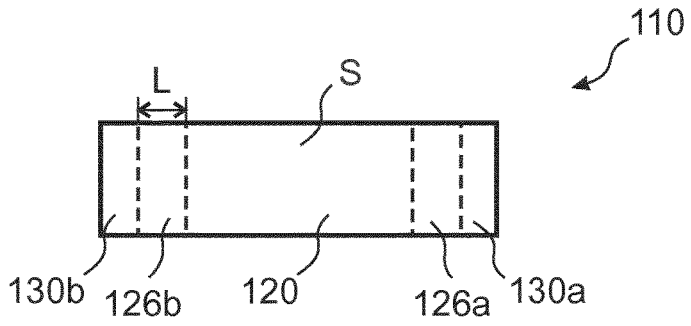

FIG. 1*b* shows a cross-sectional view of a mixing chamber of the arrangement of FIG. 1*a* taken along section lines 1*b*-1*b* of FIG. 1*a*.

Figure 2A:
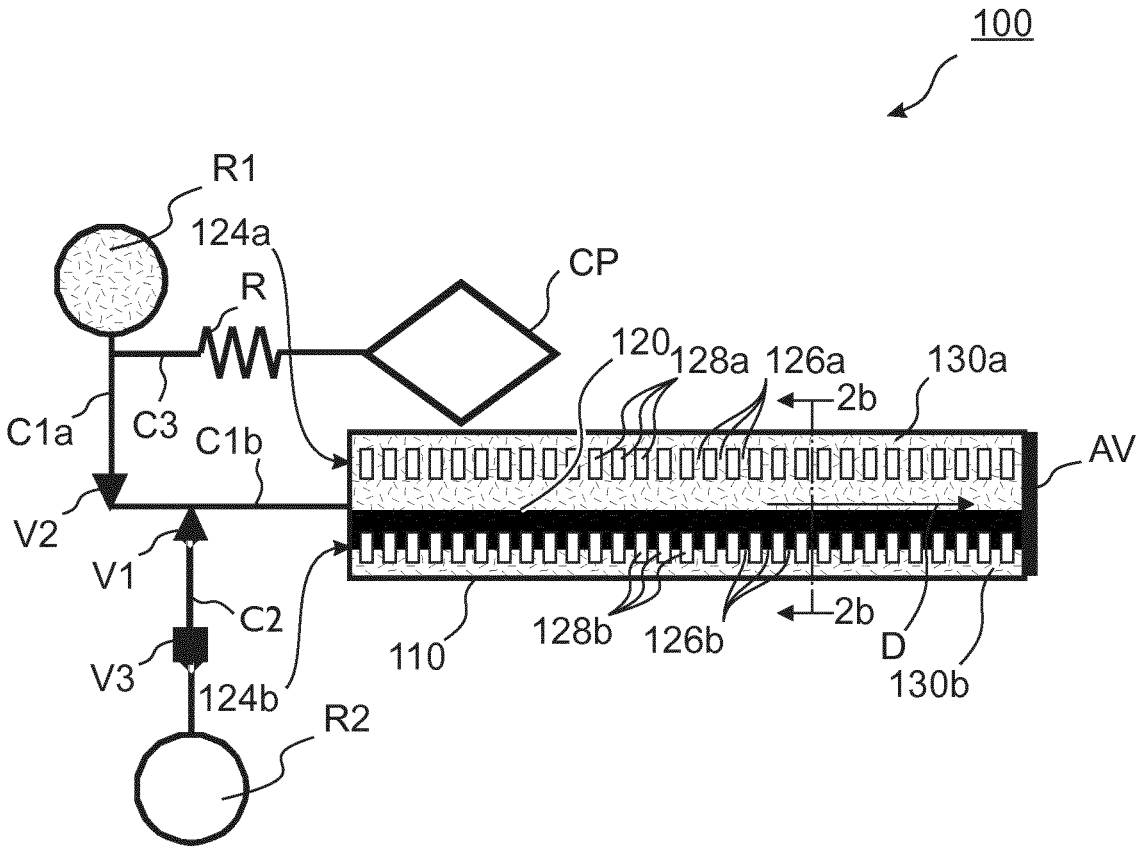

FIG. 2*a* illustrates the arrangement of FIG. 1*a* when the mixing chamber is filled with a first fluid.

Figure 2B:
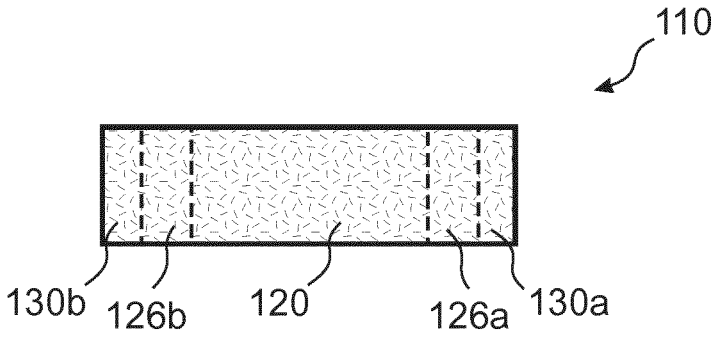

FIG. 2*b* shows a cross-sectional view of a mixing chamber of the arrangement of FIG. 2*a* taken along section lines 2*b*-2*b* of FIG. 2*a*.

Figure 3A:
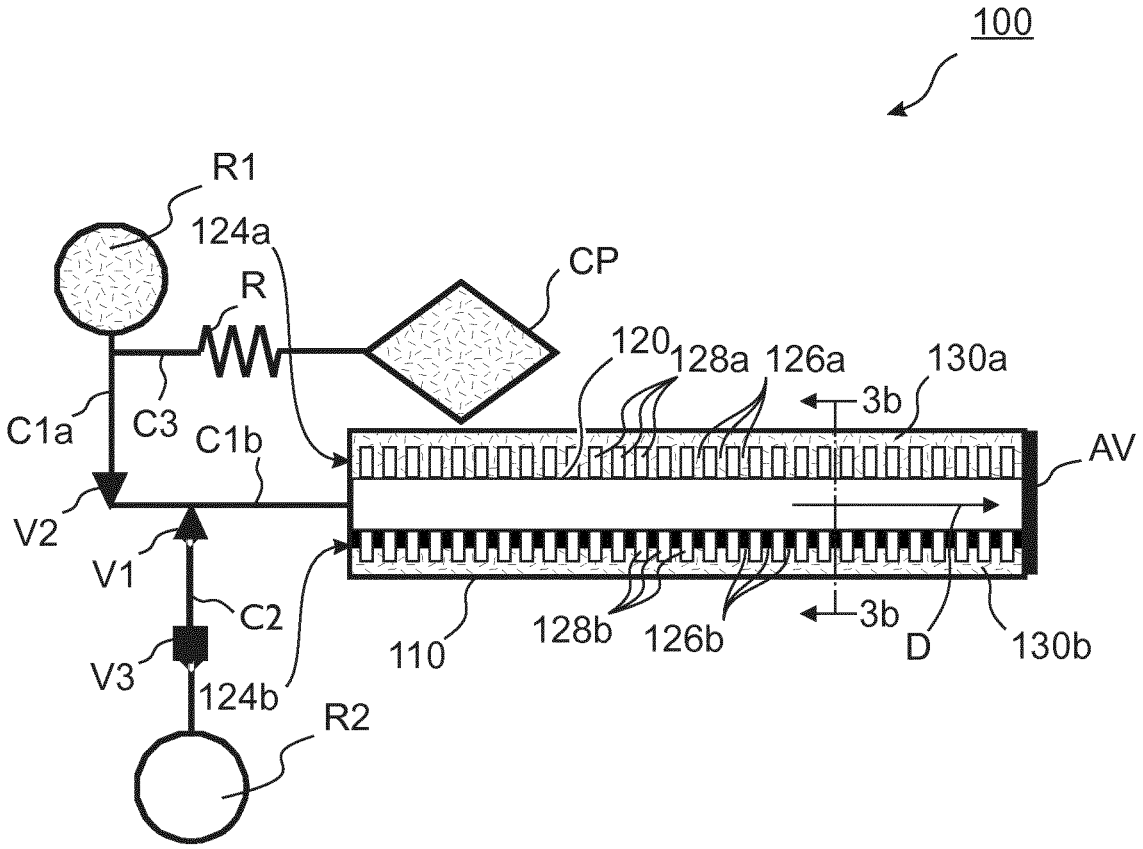

FIG. 3*a* illustrates the arrangement of FIG. 1*a* when the main chamber of the mixing chamber has been emptied of the first fluid.

Figure 3B:
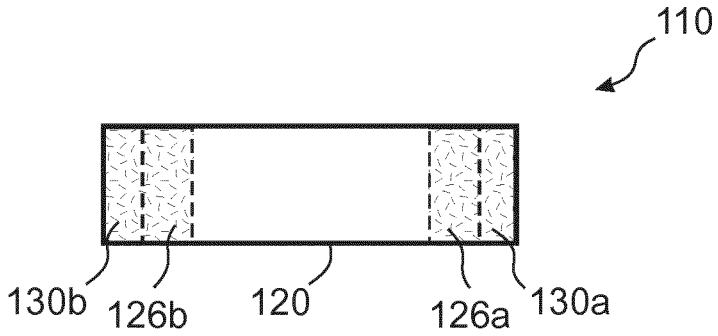

FIG. 3*b* shows a cross-sectional view of a mixing chamber of the arrangement of FIG. 3*a* taken along section lines 3*b*-3*b* of FIG. 3*a*.

Figure 4A:
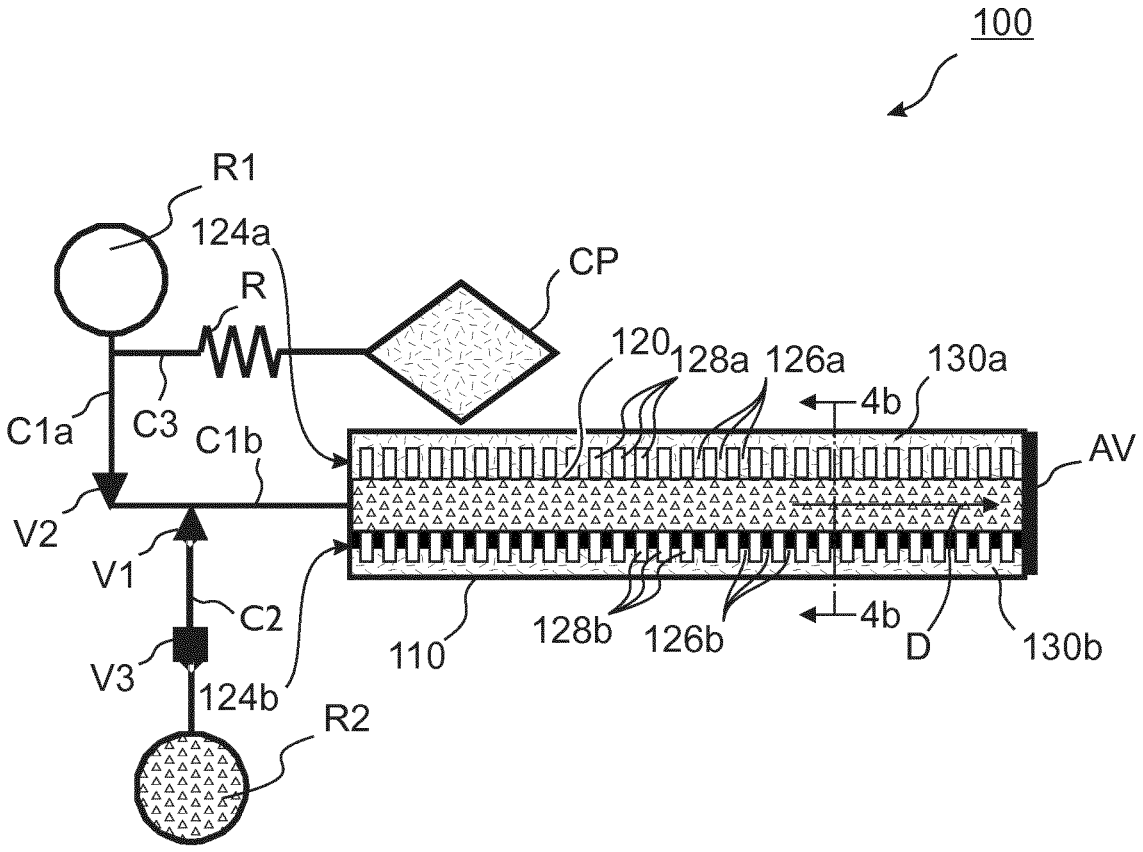

FIG. 4*a* illustrates the arrangement of FIG. 1*a* when the main chamber has been filled with a second fluid.

Figure 4B:
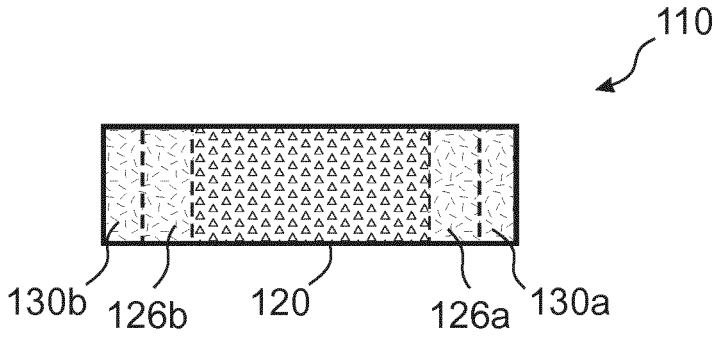

FIG. 4*b* shows a cross-sectional view of a mixing chamber of the arrangement of FIG. 4*a* taken along section lines 4*b*-4*b* of FIG. 4*a*.

Figure 5A:
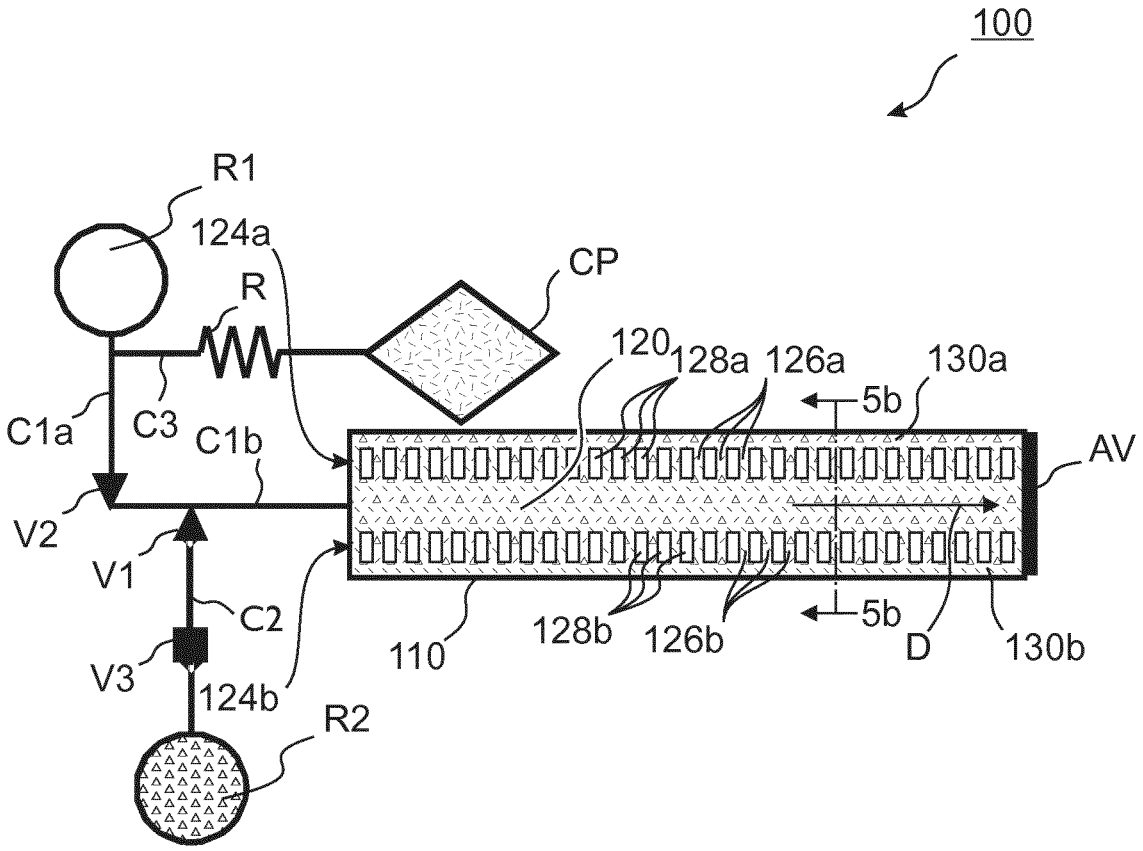

FIG. 5*a* illustrates the arrangement of FIG. 1*a* when the first and the second fluid have mixed.

Figure 5B:
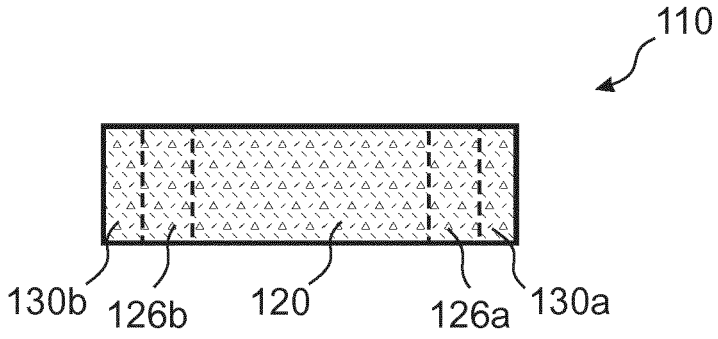

FIG. 5*b* shows a cross-sectional view of a mixing chamber of the arrangement of FIG. 5*a* taken along section lines 5*b*-5*b* of FIG. 5*a*.

Figure 6:
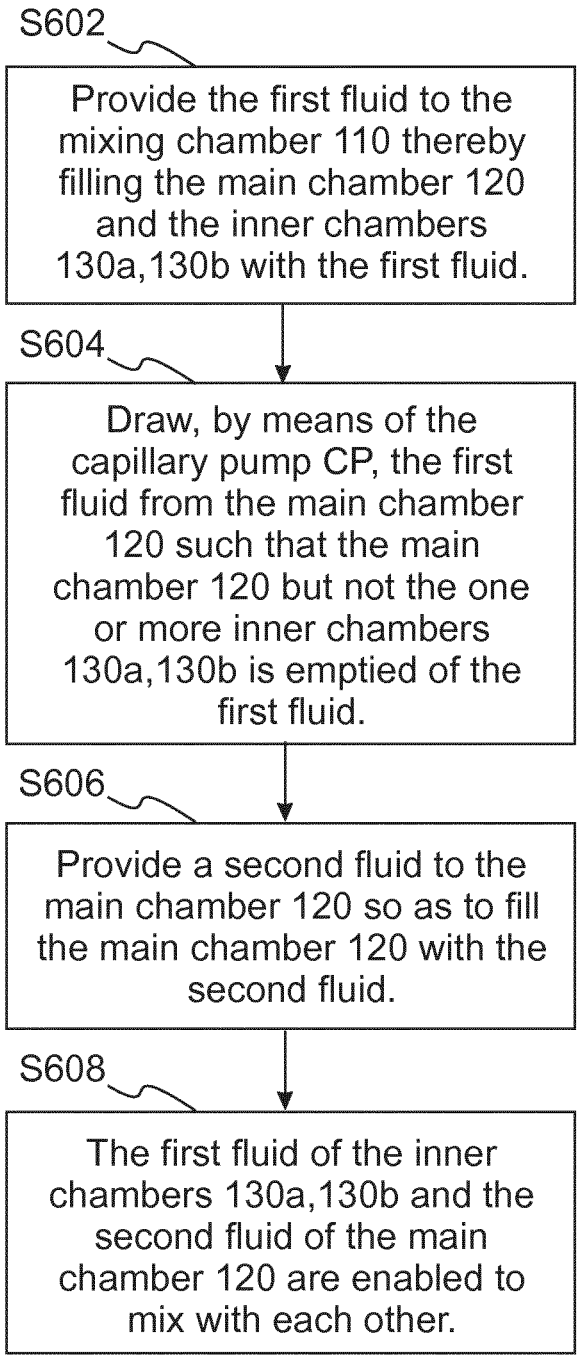

FIG. 6 shows a flow chart disclosing a series of actions taken when using the arrangement to mix a first and a second fluid.

DETAILED DESCRIPTION

It is an object to, at least partly, solve the above mentioned problem, and in particular provide an arrangement in a capillary driven fluidic system for mixing a first fluid with a second fluid at a predetermined volume mixing ratio.

According to a first aspect, there is provided an arrangement in a capillary driven fluidic system for mixing a first fluid with a second fluid at a predetermined volume mixing ratio, the arrangement comprising:

a mixing chamber including a main chamber and one or more inner chambers, said main chamber and each of the one or more inner chambers being separated by a respective structure each including at least one opening which allows for fluid communication between the main and the one or more inner chambers and which, during use, is arranged to generate a capillary pressure in the at least one opening which is larger than a capillary pressure in the main chamber, wherein the mixing chamber is arranged to receive a first fluid so as to fill the main chamber and the one or more inner chambers, via the respective at least one opening, with the first fluid, a capillary pump arranged to draw fluid from the main chamber after the main chamber and the one or more inner chambers of the mixing chamber have been filled with the first fluid, wherein the capillary pump is arranged to operate at a capillary pressure which is between the capillary pressure of the main chamber and the capillary pressure in the at least one opening of each respective structure such that the main chamber but not the one or more inner chambers is emptied of the first fluid, and wherein the mixing chamber is arranged to receive a second fluid so as to fill the main chamber with the second fluid after the main chamber has been emptied of the first fluid, such that the first fluid in the one or more inner chambers and the second fluid in the main chamber are enabled to mix through the at least one opening of the respective structure.

The arrangement is advantageous as it allows mixing a first fluid with a second fluid at a predetermined volume mixing ratio independent of the viscosities of the first and second fluids. This is achieved by sequentially filling predetermined volumes with the first and the second fluid respectively, such as to precisely metering the respective fluid. As the predetermined first and second volumes constitute separate parts of the mixing chamber, the mixing process is initiated once the first and second fluids have been delivered to the mixing chamber. In other words, the mixing process is initiated after macroscopic movement of the first and second fluids have seized, resulting in little or no influence of viscosity on the mixing. The mixing may take place through the openings defined by the structures that separate the main chamber from the one or more inner chambers. The mixing may be via diffusion, or via active mixing which disturbs the liquid interface by external forces, or both. A further advantage of the arrangement may be that the mixing chamber may be arranged such as to allow for diagnostics being performed therein. Thus, the mixing chamber may be a measurement or detection chamber. Thus, the same arrangement may essentially be used for metering, mixing and measuring the first and the second fluid.

According to some embodiments, each structure defines a plurality of openings. A large number of openings may be advantageous as it increases the effective cross section of the interface between the main chamber and the one or more inner chambers, thereby allowing for a faster mixing of the first and second fluids through the plurality of openings.

The structures may take many different forms. For example, each of the structures may be a wall which separates the main chamber from one of the inner chambers, wherein the wall defines openings, i.e., holes, which fluidically connect the main chamber to the inner chamber. Thus, a structure may be a sieve. Alternatively, a structure may be a grating.

According to some embodiments, each structure comprises a plurality of pillars, and wherein the plurality of openings is formed between the plurality of pillars. The pillars may be conveniently realized by etching techniques, and may thus be beneficial to other kinds of openings, such as drilled holes or the like. The pillars may advantageously have a rectangular cross section such as to define sharp corners of the openings between the pillars at the intersection between the structure and the main chamber. The sharp corners may allow keeping the position of the air/liquid interface better defined in relation to the openings. This allows for a more precise control of the volume of the first fluid that remains in the mixing chamber during emptying of the main chamber.

According to some embodiments, the plurality of pillars of each structure are equidistantly arranged at a distance from each other, wherein the capillary pressure in the plurality of openings depends on said distance. As readily realized by the skilled person, the capillary pressure also depends on the height of the at least one openings formed between the pillars. In some embodiments, the mixing chamber has a uniform height. This implies that the height of the openings formed between the pillars will be equal to a height of the main chamber and a height of the one or more inner chambers. Alternatively, the height of the mixing chamber may differ in different regions. For example, the height of the main chamber may be larger than the height of the at least one openings.

According to some embodiments, the mixing chamber extends in a longitudinal direction and the main chamber extends in said longitudinal direction along a full length of the mixing chamber. This may be advantageous as it allows for capillary forces within the main chamber to completely fill the main chamber and, at the same time, capillary forces within the at least one opening to fill the inner chambers.

According to some embodiments, the main chamber has a substantially uniform cross section along the longitudinal direction such that the capillary pressure formed therein will be substantially constant. This may be advantageous, as it allows for reducing the overall range of capillary pressures used within the arrangement. For embodiments having the two inner chambers disposed along opposite longitudinal sides of the mixing chamber, a further advantage of using a uniform cross section may be a more efficient mixing between the first and second fluid via the openings. The more efficient mixing results from the distance between the respective structures being constant, thus allowing for a constant diffusion length across the main chamber along the longitudinal direction. The main chamber may, alternatively, be designed such as to have a non-uniform cross section along the longitudinal direction. In such a case, the capillary pressure in the main chamber will vary depending on the position of the meniscus (or of the air-liquid interface) along the longitudinal direction. In other words, the capillary pressure within the main chamber may define a range of capillary pressures. The arrangement may still operate as intended, providing that the range of capillary pressures within the main chamber does not extend above the capillary pressure within the openings nor falls below the capillary pressure of the capillary pump.

According to some embodiments, the mixing chamber extends in a longitudinal direction, and the mixing chamber comprises two inner chambers each being separated from the main chamber by a respective structure including at least one opening, wherein the two inner chambers are disposed along opposite longitudinal sides of the mixing chamber. In this way, the interface between the main chamber and the one or more inner chambers is made as large as possible, thereby allowing for a faster mixing of the first and second fluids through the one or more openings. Furthermore, the use of two inner chambers disposed along opposite longitudinal sides of the mixing chamber allows for reducing the diffusion distance by a factor of two compared to a case where the mixing chamber only comprises one inner chamber extending along one side of the main chamber.

According to some embodiments, the arrangement further comprises a first reservoir for holding the first fluid and being arranged to provide the first fluid to the mixing chamber so as to fill the main chamber and the one or more inner chambers, via the respective at least one opening, with the first fluid, and a first channel having a first end in fluid communication with the first reservoir and a second end mouthing into the main chamber of the mixing chamber, wherein the first channel is arranged to draw fluid from the first reservoir by use of capillary forces, thereby providing the first fluid to the main chamber and the one or more inner chambers via the respective at least one openings.

According to some embodiments, the capillary pump is in fluid communication with the first channel at the first end thereof, and wherein the capillary pump is arranged to draw fluid from the main chamber via the first channel after the main chamber, the respective at least one openings, and the one or more inner chambers of the mixing chamber have been filled with the first fluid. This may be advantageous as it allows for simplifying the arrangement. Connecting the capillary pump to the first channel allows for using the same microfluidic channel for providing the first fluid to the mixing chamber as for, subsequently, emptying the first fluid from the main chamber of the mixing chamber. The capillary pump may be arranged to accommodate not only the first fluid removed from the main chamber of the mixing chamber, but also the first fluid remaining in the first reservoir. This may reduce the risk of fluid leaving the first reservoir to enter the mixing chamber at a later stage in the process, such as for example during the step of providing the second fluid to the main chamber.

According to some embodiments, the arrangement further comprises a flow resistor arranged to introduce a time delay between a time of arrival of the first fluid to the main chamber and a time of arrival of the first fluid to the capillary pump from the first reservoir, such that the capillary pump starts drawing fluid from the main chamber after the main chamber and the one or more inner chambers of the mixing chamber have been filled with the first fluid. This may be advantageous as it further simplified the arrangement eliminating the need for actively controlling the onset of emptying of the main chamber.

According to some embodiments, the arrangement further comprises a second reservoir for holding the second fluid and being arranged to provide the second fluid to the main chamber so as to fill the main chamber with the second fluid after the main chamber has been emptied of the first fluid; and a second channel being fluidically connected to the second reservoir, the second channel ending at a first unidirectional valve which is fluidically connected to the second end of the first channel such that, after the main chamber has been emptied of the first fluid, the second channel is arranged to draw fluid from the second reservoir by use of capillary forces, to provide fluid to the main chamber so as to fill the main chamber with the second fluid. This may be advantageous as it allows for providing the second fluid to the mixing chamber using the same entrance to the mixing chamber. This further aids in simplifying the arrangement.

According to some embodiments, the first channel comprises a first portion comprising the first end and a second portion comprising the second end, and wherein the first and second portions are fluidically connected to each other via a second unidirectional valve which is arranged to prevent fluid from passing from the second portion to the first portion when the second valve has been emptied of the first fluid by the capillary pump. The second unidirectional valve allows for reducing the risk of fluids unintentionally leaving, or entering, the wrong way during the steps of filling the mixing chamber with the first and second fluids. Specifically, once the first fluid has been removed from the main chamber by the capillary pump, and the second fluid is provided to the second portion of the first channel by the second channel, the second fluid is prevented from entering through the second unidirectional valve to, unintentionally, being pumped into the capillary pump. Instead, the second fluid will be driven into the main chamber of the mixing chamber to replace the first fluid which was previously removed.

According to some embodiments, the second channel further comprises a third valve arranged to open after the main chamber has been emptied of the first fluid, such as to allow providing the second fluid to the main chamber after the main chamber has been emptied of the first fluid. The third valve may be advantageous as it allows for controlling the time of providing the second fluid to the main chamber without having to time the administration of the second fluid into the second reservoir. Thus the third valve allows for having the second reservoir filled at all times, conveniently controlling the fluid flow by the third valve.

According to some embodiments, the first channel mouths into the main chamber at a first end thereof, and wherein the main chamber further comprises a vent at a second, opposite, end of the main chamber, said vent being arranged to allow gas exchange between the main chamber and the surroundings. The vent may be advantageous as it allows for removing trapped air as fluid is entering and filling up the main chamber. Similarly, the one or more inner chambers may also be connected to the vent, or, alternatively or additionally, comprise separate vents for providing air to escape from the inner chambers as fluid is driven through the at least one openings to enter the inner chambers. The vent may further act as a valve which controls the flow out of the mixing chamber at the second end. For example, the valve may be controlled to open when the first and the second fluid have been mixed in the mixing chamber so as to pass the mixed fluid on for further processing in the capillary driven fluidic system downstream of the arrangement.

According to a second aspect, there is provided a diagnostic device comprising the arrangement according to the first aspect. The diagnostic device may, e.g., be a lab-on-chip device arranged to perform tests based on one or both of the first and the second fluid.

The second aspect may generally have the same features and advantages as the first aspect. It is further noted that the inventive concepts relate to all possible combinations of features unless explicitly stated otherwise.

Exemplary embodiments will now be described more fully hereinafter with reference to the accompanying drawings. The inventive concepts may, however, be embodied in many different forms and should not be construed as limited to the embodiments set forth herein; rather, these embodiments are provided for thoroughness and completeness, and fully convey the scope of the inventive concepts to the skilled person.

The embodiments herein are not limited to the above described examples. Various alternatives, modifications and equivalents may be used. Therefore, this disclosure should not be limited to the specific form set forth herein. This disclosure is limited only by the appended claims and other embodiments than the mentioned above are equally possible within the scope of the claims.

The term "fluid" should be interpreted as a substance in liquid phase capable of being driven by capillary forces through a microfluidic system. In such a system, a fluid will form a liquid/air interface at which a capillary pressure will be formed such as to drive the fluid to flow through the system.

The term "capillary pressure", when used herein assigned to a part of the arrangement, should be interpreted as the capillary pressure arising in a fluid being driven through said part of the arrangement. It is understood that different fluids may give rise to different capillary pressures in the one and same part of the system. The related term "capillary forces" should be interpreted as the forces between the fluids and solid walls of a channel or conduit, said forces being related to, among other factors, the surface tension. As well known in the art, the capillary pressure can be related to said capillary forces.

"Mixing" should be interpreted broadly such as to encompass all processes that in one way or another will contribute to mixing between fluids. Such processes may be on the microscale, such as Brownian motion and molecular diffusion, but may also be on a macroscale such as transport of macroscopic volumes of fluid between different regions. The term "active mixing" should be construed as a mixing process which is initiated, and/or upheld, by adding a further component and/or additional energy to a system.

The arrangement will now be described in detail with reference to FIGS. 1*a* and *b* showing the arrangement in a top view and a mixing chamber of the arrangement in a side view, respectively. Reference will also be made to FIGS. 2*a,b*-5*a,b* illustrating the mixing chamber at different time positions when used to mix a first fluid with a second fluid. Reference will also be made to FIG. 6 showing a flow chart disclosing the steps corresponding to a respective on of FIGS. 2*a,b*-5*a,b*.

FIGS. 1*a* and *b* shows an arrangement 100 in a capillary driven fluidic system according to exemplary embodiments of the disclosure. The arrangement is intended for mixing a first fluid with a second fluid at a predetermined volume mixing ratio. The first and second fluids may be for example a buffer solution, such as a salt solution, and blood, respectively. The arrangement 100 may, e.g., be implemented on a chip, such as a semiconductor chip, a plastic chip or a combined semiconductor/plastic chip. The components of the arrangement may, for instance, correspond to etched structures on such a chip. The chip may be used in a diagnostic device for lab-on-chip applications, e.g., to perform diagnostic test on a sample fluid. The chip may be used as a stand-alone chip or as a cartridge to be inserted in a mating part of a diagnostic device for analysis.

The arrangement comprises a mixing chamber 110 including a first chamber, referred herein to as a main chamber 120, and one or more second chambers, referred to herein as inner chambers 130*a*,130*b*. The inner chambers 130*a*, 130*b* are arranged in relation to the main chamber 120 such that fluid may only enter and exit the one or more inner chambers 130*a*, 130*b* via the main chamber 120. The number of inner chambers 130*a*, 130*b* may vary in different embodiments. For example, in some embodiments there is only one inner chamber, whereas in the illustrated embodiment, the mixing chamber has two inner chambers 130*a*,130*b*. A reason for having more than one inner chamber may be to increase the liquid interface between the main chamber 120 and the one or more inner chambers 130*a*, 130*b*, since this will reduce the time for the two fluids to mix.

The main chamber and the one or more inner chambers may be disposed in various ways inside the mixing chamber. For example, it would in principle be possible to separate the mixing chamber 110 of FIG. 1*a* in a left and a right part and dispose the main chamber in the left part and an inner chamber in the right part. However, again, it is advantageous for reasons of reducing the mixing time to arrange the main chamber 120 and the one or more inner chambers 130*a*, 130*b* so as to make the interface between the main chamber 120 and the one or more inner chambers 130*a*, 130*b* as large as possible. Further, it is advantageous to design the mixing chamber 110 and arrange the main chamber 120 and the one or more inner chambers 130*a*, 130*b* therein to minimize the distance that constituents, such as molecules, in the fluids need to diffuse or travel in order to achieve a homogeneous mixture, since this will also affect the mixing time. In the illustrated embodiment, this is achieved by designing the mixing chamber 110 to have an elongated shape, i.e., the mixing chamber 110 extends in a longitudinal direction D. For example, the mixing chamber 110 may be a channel. Further, the main chamber 120 extends in said longitudinal direction D along a full length of the mixing chamber 110, and the two inner chambers 130*a*,130*b* are disposed along opposite longitudinal sides of the mixing chamber 110. This provides a large interface between the main chamber 120 and two inner chambers 130*a*, 130*b*, at the same time as the distance that constituents in the fluids held by the main chamber and the two inner chambers, respectively, need to diffuse or travel in order to achieve a homogeneous mixture is small.

The main chamber 120 has a substantially uniform cross section S along the longitudinal direction D such that the capillary pressure CP3 formed therein will be substantially constant. The main chamber 120 may act as a microfluidic channel, hence capable of driving a capillary flow therein. The capillary pressure CP3 will be related to, i.e., a function of the area of the cross section S of the main chamber 120. The cross section S depends on a width and height of the main chamber, respectively. For some example embodiments of the arrangement, the height of the mixing chamber may be substantially constant, and for such embodiments the relative difference between the capillary pressure in the main chamber and the openings will depend on the width of the cross section S and the distance W between the pillars, respectively.

The main chamber 120 and each of the one or more inner 130*a*,130*b* chambers are separated by a respective structure 124*a*,124*b* each defining at least one opening 126*a*,126*b* which allows for fluid communication between the main 120 and the one or more inner 130*a*,130*b* chambers. In the example embodiment, each structure 124*a*,124*b* defines a plurality of openings 126*a*,126*b*. The openings 126*a*,126*b* are arranged to generate a capillary pressure CP2 in the at least one opening 126*a*,126*b* which is larger than a capillary pressure CP3 in the main chamber 120. The capillary pressure CP2 is related to the area of the at least one opening 126*a*,126*b*. In order to achieve a capillary pressure in the at least one opening 126*a*,126*b* which is larger than a capillary pressure CP3 in the main chamber 120, the area of each of the at least one opening 126*a*,126*b* should therefore be (significantly) smaller than the area of the cross section S of the main chamber 120. Assuming a rectangular cross section S and rectangular openings 126*a*, 126*b* having the same height as the rectangular cross section S, the relation between the capillary pressures CP3 and CP2 will be defined by the width of the cross section S (i.e., the width of the main chamber 120) and the width of the openings 126*a*, 126*b*.

The structures 124*a*,124*b* may take many different forms as long as they serve to define at least one opening 126*a*, 126*b* the dimensions of which serve to generate a capillary pressure CP2 which is larger than the capillary pressure CP3 in the main chamber 120. In the illustrated embodiment, each structure 124*a*,124*b* is in the form of a row of pillars 128*a*,128*b* which extend at a right angle from a bottom surface of the mixing chamber 110. Thus, each structure 124*a*,124*b* comprises a plurality of pillars 128*a*,128*b*, and the plurality of openings 126*a*,126*b* are formed between the plurality of pillars 128*a*,128*b*. The plurality of pillars 128*a*, 128*b* of each structure 124*a*,124*b* are equidistantly arranged at a distance W from each other, wherein the capillary pressure CP2 in the plurality of openings 126*a*, 126*b* depends on said distance W. The distance W between the pillars is thus also the opening width W.

The pillars 128*a*,128*b* may have a rectangular base. This may give rise to a well-defined position of the liquid interface between a fluid held by the inner chambers 130*a*, 130*b* and a fluid held by the main chamber 120. Thus, as illustrated, each opening of the at least one openings 126*a*, 126*b* has an opening width W and an opening length L adequate to form a channel long enough for establishing the capillary pressure CP2. As the skilled person would realize, the dimensions of the at least one openings 126*a*,126*b* and pillars 128*a*, 128*b* may be different, dependent on the application. The length L may, for example, be designed such that the resulting pillars 128*a*, 128*b* do not become too fragile. The plurality of pillars 128*a*,128*b* have rectangular cross sections such as to define sharp corners of the plurality of openings 126*a*, 126*b* between the pillars 128*a*,128*b* at the intersection between each structure 124*a*,124*b* and the main chamber 120. The sharp corners may allow keeping the position of the air/liquid interface better defined in relation to the openings 126*a*, 126*b*. This allows for a more precise control of the volume of the first fluid that remains in the mixing chamber 110 during emptying of the main chamber 120.

A fluid may enter the main chamber 120 of the mixing chamber 110 at a first end thereof, as will be further described herein below. The main chamber 110 further comprises a vent AV at a second, opposite, end of the main chamber 120. The vent AV is arranged to allow gas exchange between the main chamber 120 and the surroundings, so as to avoid air being trapped in the main chamber 120 and allow air to enter the main chamber 120. The vent AV is further arranged to allow gas exchange between the inner chambers 130*a*,130*b* and the surroundings. The vent AV thus allows for removing air from the mixing chamber 110 when the mixing chamber 110 is being filled with fluid. In general, the vent AV may be open hole(s) from the closed system, i.e. the mixing chamber 110, connecting it to the outside. The vent AV may further be a valve, such as a capillary trigger valve, which controls the fluid flow out from the mixing chamber 110 at the second end.

The arrangement 100 further comprises a first reservoir R1 for holding a first fluid. The first reservoir R1 is further arranged to provide the first fluid to the mixing chamber 110 so as to fill the main chamber 120 and the one or more inner chambers 130*a*,130*b*, via the respective at least one opening 126*a*,126*b*, with the first fluid. Filling the mixing chamber 110 with the first fluid will constitute a first step in the process of mixing the first and second fluid using the arrangement 100. The first fluid is provided to the mixing chamber 110 by means of a first channel C1*a*,C1*b*. The first channel C1*a*, C1*b* is arranged to draw fluid from the first reservoir R1 by use of capillary forces. The first channel C1*a*,C1*b* has a first end in fluid communication with the first reservoir R1 and a second end mouthing into the main chamber 120 of the mixing chamber 110. The first fluid is provided to the main chamber 120 and is then further provided from the main chamber 120 into the inner chambers 130*a*,130*b* via the respective openings 126*a*,126*b*. Thus, the first fluid is driven by capillary forces formed within the first channel C1*a*,C1*b* to flow through the first channel C1*a*,C1*b* into the main chamber 120 of the mixing chamber 110. When entering the main chamber 120, the first fluid is further driven by capillary forces formed within the main chamber 120. The capillary forces within the main chamber 120 will be related to the capillary pressure CP3 of the main chamber 120.

FIGS. 2*a* and *b* illustrates the mixing chamber 110 when it is filled with the first fluid. The situation illustrated in FIGS. 2*a* and *b* will occur at the time position at which the step S602 in the flow chart of FIG. 6 has been fulfilled. Once the mixing chamber 110 has been completely filled with the first fluid, a part of the fluid within the mixing chamber 120 is removed as part of a second step in the process of mixing the first and second fluid. The removed part of the fluid will be the fluid occupying the main chamber 120, whereas the remaining part of the fluid will be the fluid occupying the inner chambers 130*a*,130*b* and the at least one openings 126*a*,126*b*.

For this purpose, the arrangement 100 further comprises a capillary pump CP. The capillary pump CP is arranged to draw fluid from the main chamber 120 after the main chamber 120 and the one or more inner chambers 130 of the mixing chamber 110 have been filled with the first fluid. The capillary pump CP is in fluid communication with the first channel C1*a*,C1*b* at the first end thereof and is arranged to draw fluid from the main chamber 120 via the first channel C1*a*,C1*b*. The capillary pump CP may be designed in different ways. The simplest possible capillary pump is a microchannel having a sufficient volume to accommodate the volume of liquid that needs to be displaced. Often, however, capillary pumps are designed such as to comprise a plurality of parallel channels which are branched off from the input channel. Thus, the capillary pressure, and in turn the pumping action, may be increased.

The capillary pump CP is arranged to operate at a capillary pressure CP1 which is between the capillary pressure CP3 of the main chamber 120 and the capillary pressure CP2 in the at least one opening 126*a*,126*b* of each respective structure 124*a*,124*b*, i.e. CP3<CP1<CP2. Selecting the operating pressure CP1 of the capillary pump in this manner allows for efficiently removing fluid from the main chamber 120 to empty the main chamber 120 while, at the same time, preventing fluid present in the inner chambers 130*a*,130*b* and the at least one openings 126*a*,126*b* from leaving the mixing chamber 110. As long as the capillary pressure CP2 in the at least one opening 126*a*,126*b* is larger than the capillary pressure CP3 of the main chamber 120 and larger than the capillary pressure CP1 of the capillary pump CP, fluid will not be driven by capillary forces to leave the inner chambers 130*a*,130*b*. Instead, a stationary liquid/air interface will be formed at the edges of the one or more openings 126*a*,126*b* facing the main chamber 120. Thus, it is understood that the first fluid will be present also within the one or more openings 126*a*,126*b* after the main chamber 120 having been emptied from the first fluid. The volume of first fluid kept in the mixing chamber is hence equal to the sum of the volumes of the one or more inner chambers 130*a*,130*b* and the at least one openings 126*a*,126*b*. This is further illustrated in FIGS. 3*a* and *b* which illustrates the mixing chamber 110 when the first fluid has been removed from the main chamber 120. The situation illustrated in FIGS. 3*a* and *b* will occur at the time position at which the step S604 in the flow chart of FIG. 6 has been fulfilled. In FIG. 3*a*, the interface of air/liquid is shown as a straight line. However, in reality it will have a slight curvature as a result from the interaction of the surface tension with the walls, so that the volume of fluid in the openings 126*a*, 126*b* will be slightly less than the volume of the openings 126*a*, 126*b*.

The capillary pressure in the first channel C1*a*,C1*b* is typically less than CP1, and preferably also greater or equal to CP3. This may be achieved by selecting the dimensions, such as the cross-sectional area, of the first channel C1*a*, C1*b* appropriately.

It is desirable that the step of emptying the main chamber 120 from the first fluid is not initiated until after the mixing chamber 110 has been completely filled with fluid. For this purpose, the arrangement 100 may further comprise a flow resistor R arranged to introduce a time delay between a time of arrival of the first fluid to the main chamber 120 and a time of arrival of the first fluid to the capillary pump CP from the first reservoir R1. This may ensure that the capillary pump CP does not start drawing fluid from the main chamber 120 unless the main chamber 120 and the one or more inner chambers 130 of the mixing chamber 110 have been filled with the first fluid.

From the above description, it is understood that fluid is to be transported through the first channel C1*a*,C1*b* in two ways; first from the first reservoir R1 to the mixing chamber 110, and then from the mixing chamber 110 to the capillary pump CP. However, to add control over the flow, the first channel C1*a*,C1*b* comprises a second unidirectional valve V2. Specifically, the first channel C1*a*,C1*b* comprises a first portion C1*a* comprising the first end and a second portion C1*b* comprising the second end, and wherein the first C1*a* and second C1*b* portions are fluidically connected to each other via the second unidirectional valve V2. The second unidirectional valve V2 is arranged to prevent fluid from passing from the second portion C1*b* to the first portion C1*a* when the second valve V2 has been emptied of the first fluid by the capillary pump CP. The second unidirectional valve V2 will be further discussed later.

The arrangement 100 further comprises a second reservoir R2 for holding a second fluid and being arranged to provide the second fluid to the main chamber 120 so as to fill the main chamber 120 with the second fluid after the main chamber 120 has been emptied of the first fluid.

The second fluid is provided to the mixing chamber 110 by means of a second channel C2 arranged to draw fluid from the second reservoir R2 by use of capillary forces. The second channel C2 is fluidically connected to the second reservoir R2 and ends at a first unidirectional valve V1 which is fluidically connected to the second end of the first channel C1*a*,C1*b*. As the first channel C1*a*,C1*b* has been emptied of the first fluid by the capillary pump CP following the step of emptying the first fluid from the main chamber 120, the second fluid will be allowed to pass through the second portion C1*b* of the first channel C1*a*,C1*b* to the main chamber 120. At the same time, the second fluid is prevented from entering through the second unidirectional valve V2 to, unintentionally, being pumped into the capillary pump CP. Instead, the second fluid will be driven into the main chamber 120 of the mixing chamber 110 to replace the first fluid which was previously removed.

The second channel C2 may further comprise a third valve V3 arranged to control the flow of the second fluid in the second channel C2. The third valve V3 may be controlled to open after the main chamber 120 has been emptied of the first fluid. In this way, the second fluid may be provided to the main chamber 120 only after the main chamber 120 has been emptied of the first fluid. The third valve may be a capillary trigger valve arranged to open when a trigger fluid reaches the valve (not shown). Alternatively, the third valve V3 may be actuated by alternative means, such as for example electromechanical actuation.

After the main chamber 120 has been filled with the second fluid from the second reservoir R2, the mixing channel 110 is thus once more filled with fluid. However, this time, the mixing chamber 120 contains two fluids. The first fluid that was initially provided from the first reservoir R1, occupies the inner chambers 130*a*,130*b* and the openings 126*a*,126*b*, whereas the second fluid, subsequently provided from the second reservoir R2, occupies the main chamber 110. This is further illustrated in FIGS. 4*a* and *b* which shows the mixing chamber 110 when it is filled with the first fluid and the second fluid. The situation illustrated in FIGS. 4*a* and *b* will occur at the time position at which the step S606 in the flow chart of FIG. 6 has been fulfilled.

The first fluid in the one or more inner chamber 130*a*, 130*b* and the second fluid in the main chamber 120 are then enabled to mix through the at least one opening 126 of the respective structure 124*a*,124*b*. The resulting mixture will have a predetermined volume mixing ratio, namely the ratio of the sum of the volumes of the one or more inner chambers 130*a*,130*b* and the at least one openings 126*a*,126*b* (i.e., volume of the first fluid), and the volume of the main chamber 120 (i.e., the volume of the second fluid). This is further illustrated in FIGS. 5*a* and *b* which shows the mixing chamber 110 after mixing of the first fluid and the second fluid. The situation illustrated in FIGS. 5*a* and *b* will occur at the time position at which the step S608 in the flow chart of FIG. 6 has been fulfilled.

At this stage, the channel C1*b* and also the second reservoir R2 are typically still filled with the second fluid. In principle, it could happen that the second fluid in the channel C1*b* and the second reservoir R2 dilute the mixture in the mixing chamber 110 with respect to the second fluid, thereby enriching the mixture with the second fluid. However, if the molecular diffusion along the longitudinal direction D is slow enough, so that the interface region between the fluid in the mixing chamber 110 and the second fluid in the channel C1*b* is limited in the longitudinal direction D, this effect will be negligible. This can be achieved by designing the volume of the mixing chamber 110 to be larger than what the assay reaction/detection needs, and thus the small volume at the interface will not interfere in the reaction/detection. Alternatively, other means may be used to stop the extra volume of the second fluid in the channel C1*b* from contacting the mixing volume. For example, an active valve (e.g., a mechanical valve) can be used to separate the mixing chamber from the C1*b* channel, or an immiscible fluid (e.g., oil) can be introduced by external pressure to isolate the mixing chamber 110 from the second fluid in the channel C1*b* (e.g., a crossing structure).

In case of an application where the fluid, after mixing, is allowed to flow out of the mixing chamber 110 for further reactions downstream, the volume of mixed fluid will typically be followed by a volume of the second fluid. However, if the volume of the mixed fluid is larger than what is needed in the following reaction, the volume of the second fluid and its interface with the mixed fluid will not interfere in the reaction.

The mixing may be based purely on molecular diffusion. Thus, it may be beneficial to have many openings in the structure to achieve a large effective cross section at which the first and second fluid meet. To speed up the mixing process, active mixing may be achieved for example by AC electro osmosis.

The first and second unidirectional valves V1,V2 described above are arranged to prevent a fluid from passing along one of the transport directions of the valves when the unidirectional valves V1,V2 are not filled with a fluid. Thus, the unidirectional valves V1,V2 may allow transport of fluid through the valves along both directions in a case where the valves are filled with a fluid.

Thus, it is to be understood that the second unidirectional valve V2 is not preventing the first fluid from passing from the second portion C1*b* to the first portion C1*a* during the step of emptying the main chamber 110 using the capillary pump CP. The second unidirectional valve V2 only prevents transport from the second portion C1*b* to the first portion C1*a* when the valve is not filled with fluid. Such a situation will arise after the main chamber 120 has been emptied. During the step of emptying the main chamber 120, air will be sucked into the main chamber 120 via the vent AV to continuously replace the volume of removed fluid. As the first fluid has left the main chamber 120 and entered the first channel C1*a*,C1*b*, air will start to replace also the first liquid occupying the first channel C1*a*,C1*b*. As the liquid/air interface reaches the second unidirectional valve V2, the valve will become air-filled and thus capable of preventing a fluid from passing the valve along that same direction at a later time. Hence, once the first fluid has been removed from the main chamber 120 by the capillary pump CP, and the second fluid is provided to the second portion C1*b* of the first channel C1*a*,C1*b* by the second channel C2, the second fluid is prevented from entering through the second unidirectional valve V2 to, unintentionally, being pumped into the capillary pump CP.

The first unidirectional valve V1 is similar to the second unidirectional valve V2 described hereinabove. The first unidirectional valve V1 is disposed such as to prevent fluid from passing from the first channel C1*a*,C1*b* to the second channel C2 when the valve is not filled with a fluid. Thus, the first fluid is prevented from entering the second channel C2 during the step of filling the mixing chamber 110 and the subsequent step of emptying the main chamber 120 via the first channel C1*a*,C1*b*.

The unidirectional valves V1,V2 may be any kind of microvalve such as mechanical, electric and thermal valves. Specifically, the unidirectional valves V1,V2 may be capillary valves based on sudden geometric expansion. In such a valve, fluid entering along a first direction through the valve may come from a first valve channel having a small cross section, said first valve channel connecting to a second valve channel having a larger cross section than the first valve channel. When the liquid/air interface of the fluid reaches the transition between the first and second valve channels, the fluid motion will seize due to a sudden decrease in capillary pressure. Fluid entering in a second, opposite, direction will come from the second valve channel having the larger cross section to the first valve channel having the smaller cross section, whereby the fluid will be allowed to be continuously driven, by capillary forces, to pass through the valve. The third valve V3 may also be a capillary valve based on sudden geometry expansion. However, the third valve V3 may differ from the first and second unidirectional valves V1,V2 in that the third valve V3 has a further entrance for allowing a second fluid, acting as a trigger fluid, to enter the third valve V3 such as to trigger opening of the valve to allow a main fluid to pass the third valve V3.

The embodiments described herein are not limited to the above described examples. Various alternatives, modifications, and equivalents may be used. For example, further valves may be included, further improving the timing control of the arrangement. Furthermore, alternative valve technologies may be used. Therefore, this disclosure should not be limited to the specific form set forth herein. This disclosure is limited only by the appended claims and other embodiments than those mentioned above are equally possible within the scope of the claims.

The invention claimed is:

1. An arrangement in a capillary driven fluidic system for mixing a first fluid with a second fluid at a predetermined volume mixing ratio, the arrangement comprising:

a mixing chamber including a main chamber and one or more inner chambers, said main chamber and each of the one or more inner chambers being separated by a respective structure each including at least one opening which allows for fluid communication between the main and the one or more inner chambers and which, during use, is arranged to generate a capillary pressure (CP2) in the at least one opening which is larger than a capillary pressure (CP3) in the main chamber, wherein the mixing chamber extends in a longitudinal direction (D) and the main chamber extends in said longitudinal direction (D) along a full length of the mixing chamber, and wherein the mixing chamber is arranged to receive a first fluid so as to fill the main chamber and the one or more inner chambers, via the respective at least one opening, with the first fluid, a capillary pump arranged to draw fluid from the main chamber after the main chamber and the one or more inner chambers of the mixing chamber have been filled with the first fluid, wherein the capillary pump is arranged to operate at a capillary pressure (CP1) which is between the capillary pressure (CP3) of the main chamber and the capillary pressure (CP2) in the at least one opening of each respective structure such that the main chamber but not the one or more inner chambers is emptied of the first fluid, and wherein the mixing chamber is arranged to receive a second fluid so as to fill the main chamber with the second fluid after the main chamber has been emptied of the first fluid, such that the first fluid in the one or more inner chambers and the second fluid in the main chamber are enabled to mix through the at least one opening of the respective structure.

2. The arrangement according to claim 1, wherein each structure defines a plurality of openings.

3. The arrangement according to claim 2, wherein each structure comprises a plurality of pillars, and wherein the plurality of openings is formed between the plurality of pillars.

4. The arrangement according to claim 3, wherein the plurality of pillars of each structure are equidistantly arranged at a distance (W) from each other, wherein the capillary pressure (CP2) in the plurality of openings depends on said distance (W).

5. The arrangement of claim 1, wherein the main chamber has a substantially uniform cross section along the longitudinal direction (D) such that the capillary pressure (CP3) formed therein will be substantially constant.

6. The arrangement according to claim 1, wherein the mixing chamber extends in a longitudinal direction (D), and the mixing chamber comprises two inner chambers each being separated from the main chamber by a respective structure including at least one opening, wherein the two inner chambers are disposed along opposite longitudinal sides of the mixing chamber.

7. The arrangement according to claim 1, further comprising:

a first reservoir for holding the first fluid and being arranged to provide the first fluid to the mixing chamber so as to fill the main chamber and the one or more inner chambers, via the respective at least one opening, with the first fluid, and a first channel having a first end in fluid communication with the first reservoir and a second end mouthing into the main chamber of the mixing chamber, wherein the first channel is arranged to draw fluid from the first reservoir by use of capillary forces, thereby providing the first fluid to the main chamber and the one or more inner chambers via the respective at least one openings.

8. The arrangement according to claim 7, wherein the capillary pump is in fluid communication with the first channel at the first end thereof, and wherein the capillary pump is arranged to draw fluid from the main chamber via the first channel after the main chamber, the respective at least one openings and the one or more inner chambers of the mixing chamber have been filled with the first fluid.

9. The arrangement according to claim 8, wherein the arrangement further comprises a flow resistor arranged to introduce a time delay between a time of arrival of the first fluid to the main chamber and a time of arrival of the first fluid to the capillary pump from the first reservoir, such that the capillary pump starts drawing fluid from the main chamber after the main chamber and the one or more inner chambers of the mixing chamber have been filled with the first fluid.

10. The arrangement according to claim 7, further comprising:

a second reservoir for holding the second fluid and being arranged to provide the second fluid to the main chamber so as to fill the main chamber with the second fluid after the main chamber has been emptied of the first fluid; and a second channel being fluidically connected to the second reservoir, the second channel ending at a first unidirectional valve which is fluidically connected to the second end of the first channel such that, after the main chamber has been emptied of the first fluid, the second channel is arranged to draw fluid from the second reservoir by use of capillary forces, to provide fluid to the main chamber so as to fill the main chamber with the second fluid.

11. The arrangement according to claim 7, wherein the first channel comprises a first portion comprising the first end and a second portion comprising the second end, and wherein the first and second portions are fluidically connected to each other via a second unidirectional valve which is arranged to prevent fluid from passing from the second portion to the first portion when the second valve has been emptied of the first fluid by the capillary pump.

12. The arrangement according to claim 7, wherein the second channel further comprises a third valve arranged to open after the main chamber has been emptied of the first fluid, such as to allow providing the second fluid to the main chamber after the main chamber has been emptied of the first fluid.

13. The arrangement according to claim 7, wherein the first channel mouths into the main chamber at a first end thereof, and wherein the main chamber further comprises a vent at a second, opposite, end of the main chamber, said vent being arranged to allow gas exchange between the main chamber and the surroundings.

* * * * *